US008314597B2

(12) United States Patent
Hsieh et al.

(10) Patent No.: US 8,314,597 B2
(45) Date of Patent: Nov. 20, 2012

(54) LOAD DRIVING APPARATUS

(75) Inventors: Chih-Yuan Hsieh, Hsinchu County (TW); Wei-Jen Lai, Yilan County (TW); Chih-Jen Yen, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 310 days.

(21) Appl. No.: 12/719,013

(22) Filed: Mar. 8, 2010

(65) Prior Publication Data

US 2011/0012571 A1 Jan. 20, 2011

(30) Foreign Application Priority Data

Jul. 17, 2009 (TW) ..... 98124287 A

(51) Int. Cl.
*G05F 1/00* (2006.01)

(52) U.S. Cl. ..... 323/281; 323/280

(58) Field of Classification Search ..... 323/281, 323/280, 273

See application file for complete search history.

(56) References Cited

U.S. PATENT DOCUMENTS

| | | | | |
|---|---|---|---|---|
| 6,710,583 | B2 * | 3/2004 | Stanescu et al. | 323/280 |
| 7,015,680 | B2 | 3/2006 | Moraveji et al. | |
| 7,339,775 | B2 | 3/2008 | Kimura | |
| 2006/0012932 | A1 | 1/2006 | Kitagawa | |

FOREIGN PATENT DOCUMENTS

| | | |
|---|---|---|
| CN | 1578095 | 2/2005 |
| TW | 200805862 | 1/2008 |
| TW | 200828209 | 7/2008 |

OTHER PUBLICATIONS

"First Office Action of China Counterpart Application", issued on Feb. 28, 2012, p. 1-p. 7, in which the listed reference was cited.

Thiele et al, "Current-Mode LDO with Active Dropout Optimization," Power Electronics Specialists Conference, 2005, PESC '05. IEEE 36th, Jun. 16, 2005, pp. 1203-1208.

"Office Action of Taiwan Counterpart Application", issued on Sep. 12, 2012, p1-p8, in which the listed references were cited.

* cited by examiner

*Primary Examiner* — Shawn Riley
(74) *Attorney, Agent, or Firm* — Jianq Chyun IP Office

(57) ABSTRACT

A load driving apparatus is provided. The load driving apparatus is configured to output an electrical signal to a load. The load driving apparatus includes a driver and an average voltage/current detector. The driver receives an input voltage and a control signal. The driver tunes the electrical signal according to the control signal. The average voltage/current detector receives the electrical signal outputted to the load and generates the control signal by comparing the electrical signal and a reference signal.

10 Claims, 4 Drawing Sheets

LOAD DRIVING APPARATUS

CROSS-REFERENCE TO RELATED APPLICATION

This application claims the priority benefit of Taiwan application serial no. 98124287, filed on Jul. 17, 2009. The entirety of the above-mentioned patent application is hereby incorporated by reference herein and made a part of specification.

BACKGROUND OF THE INVENTION

1. Field of the Invention

The present invention generally relates to a load driving apparatus.

2. Description of Related Art

In the related art of a load driving apparatus, since an input voltage received by the load driving apparatus usually has ripples, an electrical signal transmitted thereby to drive a load also has the ripples. As a result, the electrical signal received by the load may be insufficient, so that the efficiency of the whole load driving apparatus is reduced.

Accordingly, the related art provides a load driving apparatus to solve the above-described issue. FIG. 1 is a schematic diagram of a conventional driving apparatus. Referring to FIG. 1, the driver 110 receives an input voltage VIN and transmits an electrical signal IV to a load 120. Moreover, the driver 110 further detects a feedback signal FB from the load 120 to serve as a basis for dynamically tuning the electrical signal IV.

However, the feedback signal FB received by this kind of driver 110 in the related art is usually the peak value of the electrical signal IV received by the load 120. Generally, while the system is designed, the optimum set value of the load 120, however, is represented by the average voltage or the average current. Accordingly, the above-described controlling method through the feedback can not satisfy the requirement. The average value of the electrical signal IV for driving the load 120 in practice may be lower than the optimum set value originally designed for the load 120, so that the efficiency of the load 120 is seriously reduced.

SUMMARY OF THE INVENTION

One embodiment of the invention provides a load driving apparatus. The average value of an electrical signal provided thereby is equal to the requirement of a load.

One embodiment of the invention provides a load driving apparatus configured to output an electrical signal to a load. The load driving apparatus includes a driver and an average voltage/current detector. The driver is coupled to the load and receives an input voltage and a control signal. The driver tunes the outputted electrical signal according to the control signal. The average voltage/current detector is coupled to the driver and the load. The average voltage/current detector receives the electrical signal outputted to the load, and generating the control signal by comparing the electrical signal with a reference signal.

In one embodiment of the invention, the above-described driver is a power converter.

In one embodiment of the invention, the above-described electrical signal is a driving current.

In one embodiment of the invention, the above-described average voltage/current detector includes a current sensor, a current-to-voltage converter, and a comparator. The current sensor is coupled to the load and configured to sense the driving current. The current-to-voltage converter is coupled to the current sensor and configured to convert the sensed driving current to a comparison voltage. The comparator is coupled to the current sensor and the current-to-voltage converter and configured to compare the reference signal with the comparison voltage to generate the control signal.

In one embodiment of the invention, the above-described current-to-voltage converter is a converting resistor having one end receiving the driving current and the other end coupled to a ground voltage.

In one embodiment of the invention, the above-described comparator is an operational transconductance amplifier (OTA).

In one embodiment of the invention, the load driving apparatus further includes a reference signal generating circuit configured to generate the reference signal. The reference signal generating circuit includes a reference current source and a reference resistor. The reference current source is coupled to the comparator and provides a reference current. One end of the reference resistor receives the reference current and generates the reference signal, and the other end thereof is coupled to the ground voltage.

In one embodiment of the invention, the above-described current-to-voltage converter includes a first converting capacitor and a first converting switch. One end of the first converting capacitor receives the driving current, and the other end thereof is coupled to a ground voltage. The first converting switch is coupled with the first converting capacitor in parallel.

In one embodiment of the invention, the above-described load driving apparatus further includes a reference signal generating circuit configured to generate the reference signal. The reference signal generating circuit includes a reference current source, a second converting capacitor, and a second converting switch. The reference current source is coupled to the comparator and provides a reference current. One end of the second converting capacitor receives the reference current, and the other end thereof is coupled to a ground voltage. The second converting switch is coupled with the second converting capacitor in parallel.

In one embodiment of the invention, the above-described electrical signal is a driving voltage.

In one embodiment of the invention, the above-described average voltage/current detector includes a first voltage-to-current converter, a current-to-voltage converter, and a comparator. The first voltage-to-current converter is coupled to the load and configured to receive and convert the driving voltage to generate a converted current. The current-to-voltage converter is coupled to the first voltage-to-current converter and configured to convert the converted current to a comparison voltage. The comparator is coupled to the first voltage-to-current converter and the current-to-voltage converter and configured to compare the reference signal with the comparison voltage to generate the control signal.

In one embodiment of the invention, the above-described current-to-voltage converter is a converting resistor having one end receiving the converted current and the other end coupled to a ground voltage.

In one embodiment of the invention, the above-described load driving apparatus further includes a reference signal generating circuit configured to generate the reference signal. The reference signal generating circuit includes a second voltage-to-current converter and a reference resistor. The second voltage-to-current converter is coupled to the comparator, receives a reference voltage, and converts the reference voltage to generate a reference current. One end of the reference resistor receives the reference current and generates the reference signal, and the other end thereof is coupled to the ground voltage.

In one embodiment of the invention, the above-described current-to-voltage converter includes a first converting capacitor and a first converting switch. One end of the first converting capacitor receives the driving current, and the other end thereof is coupled to a ground voltage. The first converting switch is coupled with the first converting capacitor in parallel.

In one embodiment of the invention, the above-described load driving apparatus further includes a reference signal generating circuit configured to generate the reference signal. The reference signal generating circuit includes a second voltage-to-current converter, a second converting capacitor, and a second converting switch. The second voltage-to-current converter is coupled to the comparator, receives a reference voltage, and converts the reference voltage to generate a reference current. One end of the second converting capacitor receives the reference current, and the other end thereof is coupled to a ground voltage. The second converting switch is coupled with the second converting capacitor in parallel.

In one embodiment of the invention, the above-described load driving apparatus further includes a buffer coupled to a path in series in which the comparator receives the driving voltage.

In one embodiment of the invention, the above-described average voltage/current detector includes a comparator. The comparator receives the driving voltage and the reference signal and compares the reference signal and the driving voltage to generate the control signal. Wherein, the reference signal is a voltage signal.

In view of the above, the electrical signal (a current or a voltage) on the load is fed back, and the electrical signal is compared with the reference signal to tune the electrical signal outputted by the load driving apparatus in the embodiment of the invention. Accordingly, the average value of the electrical signal outputted by the load driving apparatus is substantially equal to the required value of the load, and the efficiency of the load driving apparatus is further enhanced.

To make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
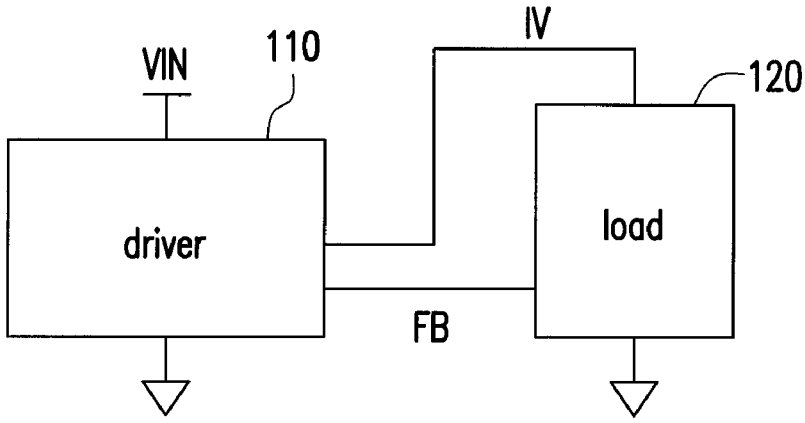
FIG. 1 (RELATED ART)
FIG. 1 is a schematic diagram of a conventional driving apparatus.
Figure 2:
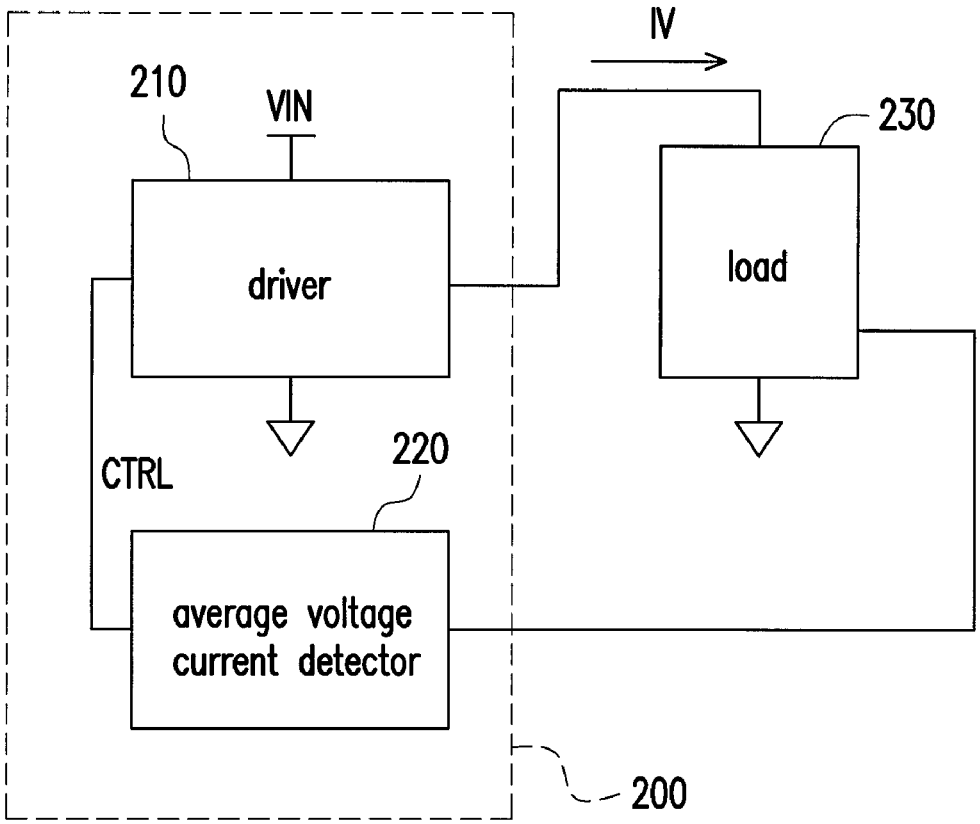
FIG. 2 is a schematic diagram of a load driving apparatus according to a first embodiment of the invention.

FIG. 2 is a schematic diagram of a load driving apparatus according to a first embodiment of the invention. Referring to FIG. 2, the load driving apparatus 200 is connected to a load 230 and outputs an electrical signal IV to drive the load 230. The load driving apparatus 200 includes a driver 210 and an average voltage/current detector 220. The driver 210 is coupled to the load 230 and the average voltage/current detector 220. The driver 210 receives an input voltage YIN and a control signal CTRL. The electrical signal IV is outputted by the driver 210, and the driver 210 tunes the electrical signal IV outputted thereby according to the control signal CTRL.

The driver 210 may be configured by a power converter. That is, the driver 210 may be a voltage converter or a current converter. This kind of power converter is able to generate the outputted electrical signal IV according to the input voltage VIN received thereby. The above-described power converter is a circuit that can be easily understood by those of ordinary skill in the art, and thus it will not be described in detail herein.

The average voltage/current detector 220 is also coupled to the load 230, and the electrical signal IV is received by the load 230. The average voltage/current detector 220 compares the electrical signal IV received thereby with a reference signal, and generating the control signal CTRL according to a compared result.

Herein, the electrical signal IV may be a driving current or a driving voltage for driving the load 230. The formation of the electrical signal IV may be determined according to the load 230 driven by a current or a voltage. When the load 230 is driven by the current, the electrical signal IV is the driving current. Alternatively, when the load 230 is driven by the voltage, the electrical signal IV is the driving voltage.

It should be noted that, the above-described reference signal may be set according to the value of the electrical signal IV which is required by the load 230. For example, when the electrical signal IV is the driving voltage, if the better driving voltage required by the load 230 is 5 voltages (V), the reference signal is set according to 5V, so that the reference signal is exemplarily set as 5V.

For the different load driving apparatuses outputting the different formations of the electrical signals IV, a plurality of embodiments will be described as follows. Accordingly, those of ordinary skill in the art can understand more about the invention and implement that.

Figure 3:
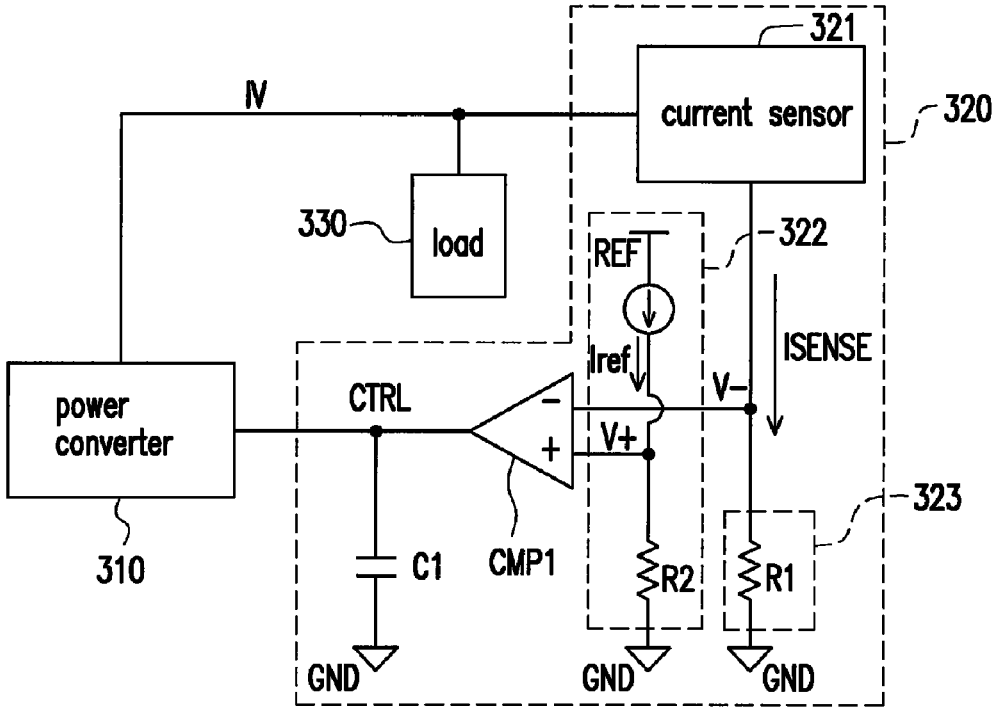
FIG. 3 is a schematic diagram of a load driving apparatus according to a second embodiment of the invention.

FIG. 3 is a schematic diagram of a load driving apparatus according to a second embodiment of the invention. Referring to FIG. 3, the load driving apparatus is composed of a power converter 310 and an average voltage/current detector 320. The power converter 310 receives a control signal CTRL and accordingly generates an electrical signal IV with the current formation to drive a load 330. Wherein, the average voltage/current detector 320 includes a current sensor 321, a current-to-voltage converter 323, a comparator CMP1, and a reference signal generating circuit 322.

The current sensor 321 is coupled to the load 330. The current sensor 321 receives the electrical signal IV with the current formation and transmits a sensed driving current ISENSE to be passed through the current-to-voltage converter 323. The current-to-voltage converter 323 is formed by a converting resistor R1. The converting resistor R1 is coupled between current sensor 321 and a ground voltage GND. One end of the converting resistor R1 receives the sensed driving current ISENSE and the other end thereof is coupled to the ground voltage GND. When the sensed driving current ISENSE flows through the converting resistor R1, a comparison voltage V− is generated at the end of the converting resistor R1 receiving the sensed driving current ISENSE.

Moreover, a reference signal V+ is generated by the reference signal generating circuit 322. In the present embodiment, the reference signal generating circuit 322 includes a reference current source REF and a reference resistor R2. One end of the reference resistor R2 receives a reference current Iref provided by the reference current source REF, and the other end thereof is coupled to the ground voltage GND. When the reference current Iref passes through the reference resistor R2, the reference signal V+ is immediately generated at the end of the reference resistor R2 coupled to the reference current source REF.

The comparator CMP1 receives the reference signal V+ and the comparison voltage V− and generates the control signal CTRL by comparing the reference signal V+ and the comparison voltage V−. Moreover, the end of the comparator CMP1 outputting the control signal CTRL may be coupled to the ground voltage GND through a stabilizing capacitor C1 coupled thereto in series. In the present embodiment, the comparator CMP1 is formed by an operational amplifier. Apparently, the comparator CMP1 may be formed by an operational transconductance amplifier (OTA).

As known from the above, under the situation in which the comparator CMP1 generates the control signal CTRL by comparing the reference signal V+ and the comparison voltage V−, the average value of the electrical signal IV (the driving current) generated by the power converter 310 according to the control signal CTRL highly approximates to the required driving current, so that the load 330 can achieve the maximum performance thereof.

Figure 4:
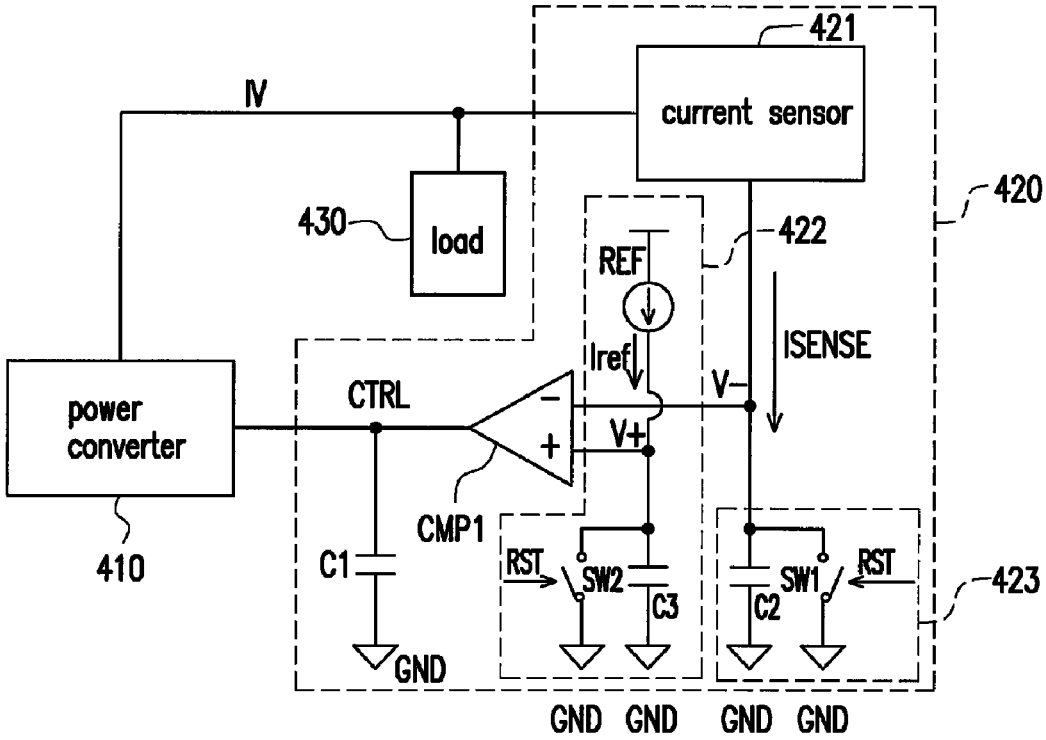
FIG. 4 is a schematic diagram of a load driving apparatus according to a third embodiment of the invention.

FIG. 4 is a schematic diagram of a load driving apparatus according to a third embodiment of the invention. Referring to FIG. 4, the load driving apparatus is composed of a power converter 410 and an average voltage/current detector 420. The power converter 410 is coupled to a load 430 and provides an electrical signal IV to drive the load 430. The difference from the above embodiment lies in that, a current-to-voltage converter 423 included in the average voltage/current detector 420 in the present embodiment is formed by a converting capacitor C2 and a converting switch SW1. Wherein, the converting capacitor C2 is coupled with the converting switch SW1 in parallel. Furthermore, one end of the converting capacitor C2 receives the sensed driving current ISENSE, and the other end thereof is coupled to a ground voltage GND.

The converting switch SW1 is controlled by a resetting signal RST. When a broken circuit is formed due to the converting switch SW1 turned off according to the resetting signal RST, the converting capacitor C2 receives the driving current ISENSE to be charged. Accordingly, the comparison voltage V− is gradually raised as time goes by. When the converting switch SW1 is turned on according to the resetting signal RST, the charges of the converting capacitor C2 is leaked out to the ground voltage GND, so that the comparison voltage V− is equal to the ground voltage GND.

Moreover, besides a reference current source REF, a reference signal generating circuit 422 in the present embodiment further includes a converting capacitor C3 and a converting switch SW2. The converting capacitor C3 is coupled with the converting switch SW2 in parallel. Furthermore, one end of the converting capacitor C3 receives a reference current Iref generated by a reference current source REF, and the other end thereof is coupled to the ground voltage GND. Moreover, the converting switch SW2 is controlled by the resetting signal RST. The operation of the converting capacitor C3 and the converting switch SW2 is similar to that of the current-to-voltage converter 423, and it will not be described in detail herein.

Figure 5:
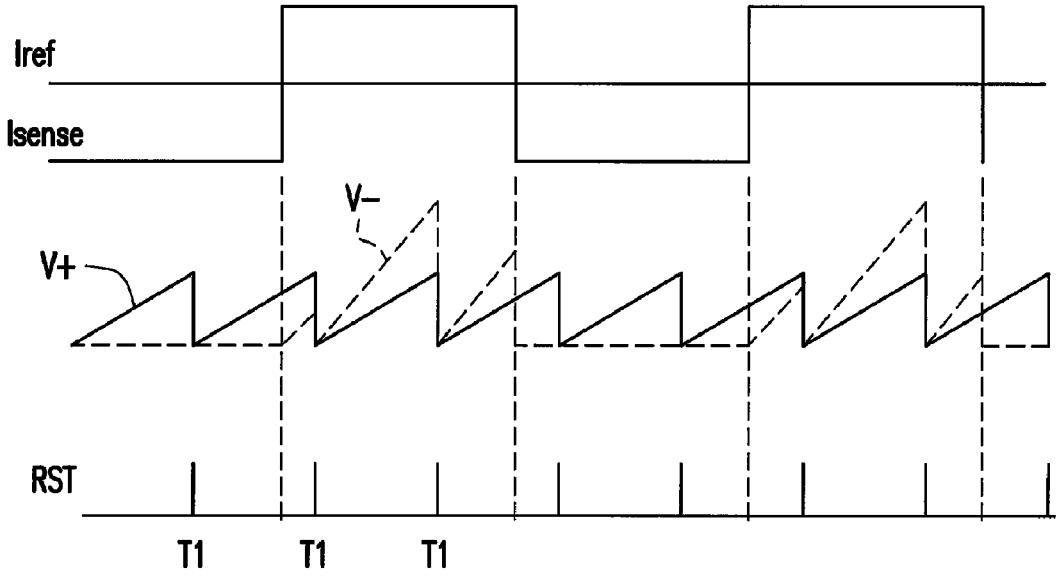
FIG. 5 illustrates waveforms of the signals while the load driving apparatus shown in FIG. 4 operates according to the third embodiment of the invention.

FIG. 5 illustrates waveforms of the signals while the load driving apparatus shown in FIG. 4 operates according to the third embodiment of the invention. Referring to FIG. 5, when the resetting signal RST is held at a low voltage level, the converting switches SW1 and SW2 are kept open, and the comparison voltage V− and the reference signal V+ are raised as time goes by. Once a spike having a high voltage level is generated in the resetting signal RST at a time T1, the converting capacitors C2 and C3 are discharged at this moment, and the comparison voltage V− and the reference signal V+ are reset to a zero voltage level.

Moreover, as known form FIG. 5, when the comparison voltage V− is lower than the reference signal V+, it means that the driving current ISENSE is less than the reference current Iref. Meanwhile, the power converter 410 raises the driving current ISENSE according to the control signal CTRL. On the contrary, when the comparison voltage V− is higher than the reference signal V+, it means that the driving current ISENSE is more than the reference current Iref. Meanwhile, the power converter 410 lowers the driving current ISENSE according to the control signal CTRL. As a result, the average value of the driving current ISENSE will highly approximate to the reference current Iref.

Figure 6:
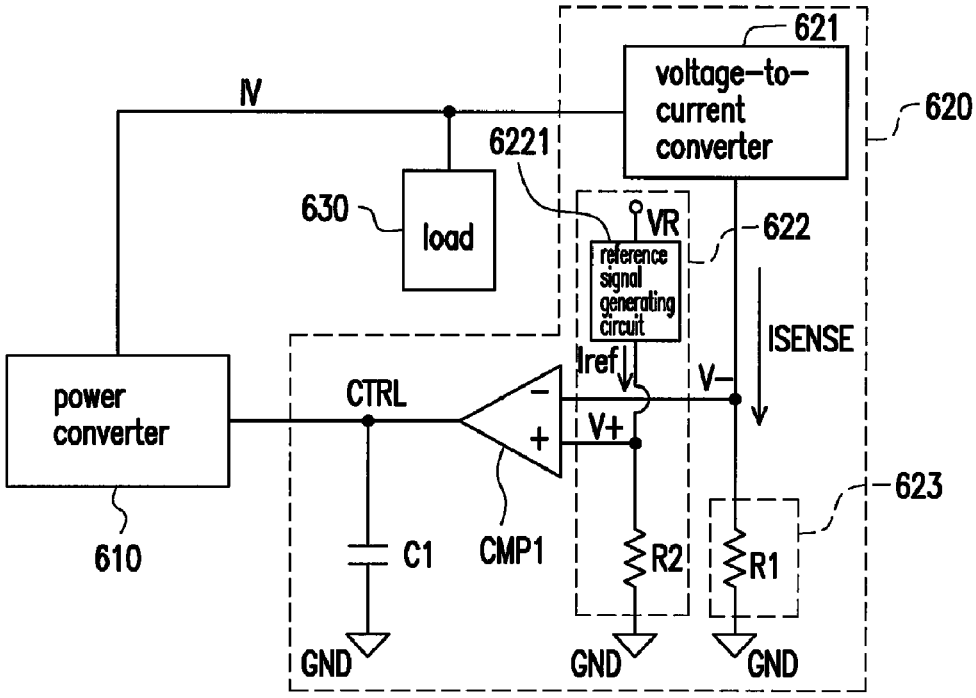
FIG. 6 is a schematic diagram of a load driving apparatus according to a fourth embodiment of the invention.

FIG. 6 is a schematic diagram of a load driving apparatus according to a fourth embodiment of the invention. Referring to FIG. 6, the load driving apparatus is composed of a power converter 610 and an average voltage/current detector 620. The power converter 610 receives a control signal CTRL and accordingly generates an electrical signal IV with the voltage formation to drive a load 630. Wherein, the average voltage/current detector 620 includes a voltage-to-current converter 621, a current-to-voltage converter 623, and a reference signal generating circuit 622.

The voltage-to-current converter 621 receives the electrical signal IV with the voltage formation and converts the electrical signal IV to generate a converted driving current ISENSE. The current-to-voltage converter 623 may be formed by a converting resistor R1, wherein one end of the converting resistor R1 receives the converted driving current ISENSE, and the other end thereof is coupled to a ground voltage GND.

The reference signal generating circuit 622 includes a voltage-to-current converter 6621 and a reference resistor R2. The voltage-to-current converter 6621 receives a reference voltage VR to generate a reference current Iref. One end of the reference resistor R2 receives the reference current Iref, and the other end thereof is coupled to the ground voltage GND.

The operation of the load driving apparatus in the fourth embodiment is very similar to that of the load driving apparatus in the second embodiment. The difference therebetween lies in that, the electrical signal IV generated by the power converter 610 in the fourth embodiment has the voltage formation. Accordingly, in the fourth embodiment, the electrical signal IV is required to be converted to the converted driving current ISENSE through the voltage-to-current converter 621. For the reference current Iref, it is also obtained by converting the provided reference voltage VR through the reference signal generating circuit 6221. The operation of the load driving apparatus in the fourth embodiment is the same as that of the load driving apparatus in the second embodiment except for the above-described difference, and it will not be described in detail herein.

Figure 7:
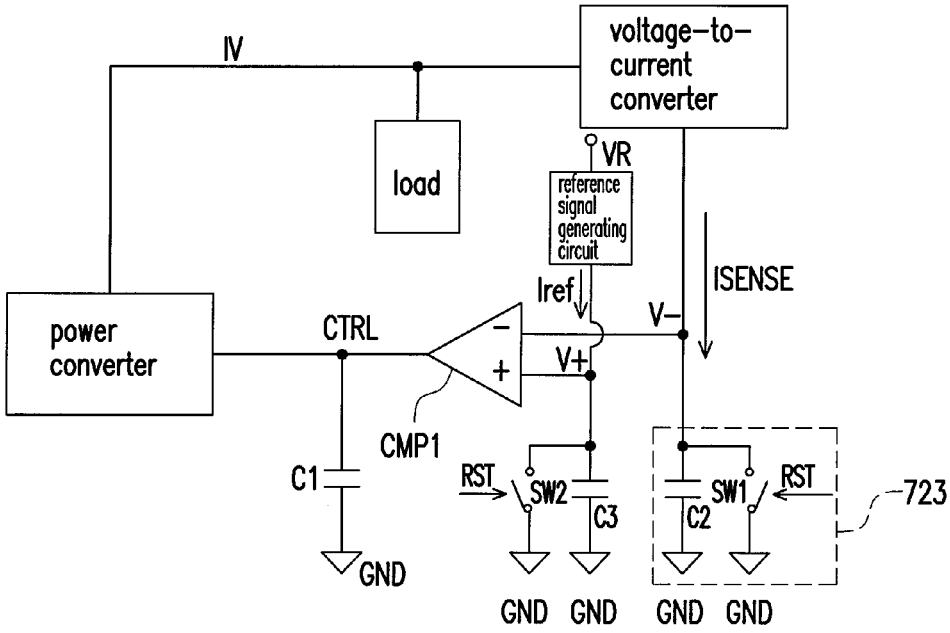
FIG. 7 is a schematic diagram of a load driving apparatus according to a fifth embodiment of the invention.

FIG. 7 is a schematic diagram of a load driving apparatus according to a fifth embodiment of the invention. Referring to FIG. 7, the load driving apparatus in the fifth embodiment of the invention is substantially the same as the load driving apparatus in the fourth embodiment. The difference therebetween lies in that, the converting resistor R1 in the fourth embodiment has been replaced by a current-to-voltage converter 723 formed by the converting capacitor C2 and the converting switch SW1 coupled in parallel in the fifth embodiment. In the reference signal generating circuit, the reference resistor R2 in the fourth embodiment has been replaced by the converting capacitor C3 and the converting switch SW2.

Wherein, one end of the converting capacitor C2 receives the converted driving current ISENSE, and the other end thereof is coupled to a ground voltage GND. The converting capacitor C3 is coupled with the converting switch SW2 in parallel. Furthermore, one end of the converting capacitor C3 receives a reference current Iref, and the other end thereof is coupled to the ground voltage GND. The converting switches SW1 and SW2 are both controlled by the resetting signal RST. With respect to the operation of the converting capacitors C2 and C3 and the converting switches SW1 and SW2, it has been described in detail in the third embodiment and will not be described again herein.

Figure 8:
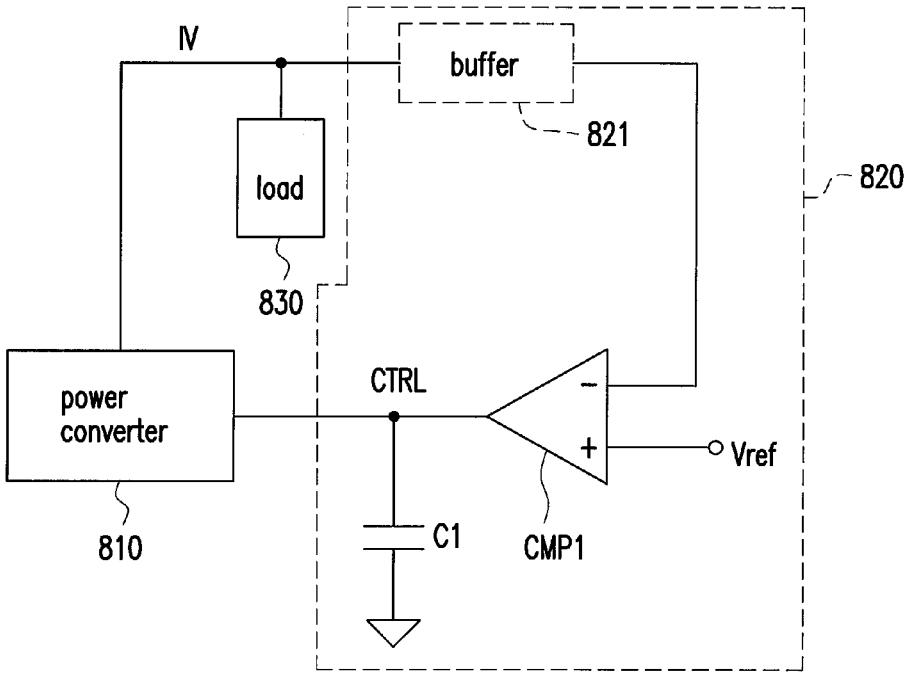
FIG. 8 is a schematic diagram of a load driving apparatus according to a sixth embodiment of the invention.

FIG. 8 is a schematic diagram of a load driving apparatus according to a sixth embodiment of the invention. Referring to FIG. 8, the load driving apparatus is composed of a power converter 810 and an average voltage/current detector 820. The power converter 810 generates an electrical signal IV with the voltage formation to drive a load 830 according to a control signal CTRL. The average voltage/current detector 820 includes a comparator CMP1. The comparator CMP1 directly receives the electrical signal IV and the reference current Iref to be compared, and generates the control signal CTRL. Herein, the reference signal Vref is a voltage signal with the voltage formation.

Moreover, a buffer 821 may be coupled to a path in series in which the comparator CMP1 receives the electrical signal IV to ensure the stability of the electrical signal.

To sum up, by feeding back the electrical signal on the load, the electrical signal is compared with the reference signal, so that the average value of the electrical signal is substantially equal to the required energy of the load Accordingly, the work efficiency of the load is effectively enhanced.

Although the present invention has been described with reference to the above embodiments, it is apparent to one of the ordinary skill in the art that modifications to the described embodiments may be made without departing from the spirit of the invention. Accordingly, the scope of the invention will be defined by the attached claims not by the above detailed descriptions.

What is claimed is:

1. A load driving apparatus, configured to output an electrical signal to a load, comprising:

a driver, coupled to the load, for receiving an input voltage and a control signal and outputting an electrical signal, wherein the driver tunes the electrical signal according to the control signal; and an average voltage/current detector, coupled to the driver and the load, for receiving the electrical signal outputted to the load, and generating the control signal by comparing the electrical signal with a reference signal, wherein the electrical signal is a driving current, and the average voltage/current detector comprises:

a current sensor, coupled to the load, configured to sense the driving current;

a current-to-voltage converter, coupled to the current sensor, configured to convert the sensed driving current to a comparison voltage; and a comparator, coupled to the current sensor and the current-to-voltage converter, wherein the comparator compares the reference signal with the comparison voltage to generate the control signal.

2. The load driving apparatus as claimed in claim 1, wherein the driver is a power converter.

3. The load driving apparatus as claimed in claim 1, wherein the current-to-voltage converter is a converting resistor having one end receiving the driving current and the other end coupled to a ground voltage.

4. The load driving apparatus as claimed in claim 1, wherein the comparator is an operational transconductance amplifier (OTA).

5. The load driving apparatus as claimed in claim 4, further comprising:

a reference signal generating circuit, configured to generate the reference signal, comprising:

a reference current source, coupled to the comparator and providing a reference current; and a reference resistor having one end receiving the reference current and generating the reference signal and the other end coupled to the ground voltage.

6. The load driving apparatus as claimed in claim 3, wherein the current-to-voltage converter comprises:

a first converting capacitor having one end receiving the driving current and the other end coupled to a ground voltage;

a first converting switch coupled with the first converting capacitor in parallel.

7. The load driving apparatus as claimed in claim 6, further comprising:

a reference signal generating circuit, configured to generate the reference signal, comprising:

a reference current source coupled to the comparator and providing a reference current;

a second converting capacitor having one end receiving the driving current and the other end coupled to a ground voltage; and a second converting switch coupled with the second converting capacitor in parallel.

8. A load driving apparatus, configured to output an electrical signal to a load, comprising:

a driver, coupled to the load, for receiving an input voltage and a control signal and outputting an electrical signal, wherein the driver tunes the electrical signal according to the control signal; and an average voltage/current detector, coupled to the driver and the load, for receiving the electrical signal outputted to the load, and generating the control signal by comparing the electrical signal with a reference signal, wherein the electrical signal is a driving voltage, and the average voltage/current detector comprises:

a first voltage-to-current converter, coupled to the load, wherein the first voltage-to-current converter receives and converts the driving voltage for generating a converted current;

a current-to-voltage converter, coupled to the first voltage-to-current converter, for converting the converted current to a comparison voltage;

a comparator, coupled to the first voltage-to-current converter and the current-to-voltage converter, wherein the comparator compares the reference signal with the comparison voltage to generate the control signal, wherein the current-to-voltage converter comprises:

a first converting capacitor having one end receiving the driving current and the other end coupled to a ground voltage; and a first converting switch coupled with the first converting capacitor in parallel.

9. The load driving apparatus as claimed in claim 8, wherein the comparator is an operational transconductance amplifier (OTA).

10. The load driving apparatus as claimed in claim 8, further comprising:

a reference signal generating circuit, configured to generate the reference signal, comprising:

a second voltage-to-current converter, coupled to the comparator, wherein the second voltage-to-current converter receives a reference voltage and converts the reference voltage to generate a reference current; and a second converting capacitor having one end receiving the driving current and the other end coupled to a ground voltage; and a second converting switch coupled with the second converting capacitor in parallel.

* * * * *